US005913407A

United States Patent [19]

Keyes

[11] Patent Number: 5,913,407

[45] Date of Patent: Jun. 22, 1999

[54] BIRTHWEAR AND METHOD RELATED THERETO

[75] Inventor: Virginia Carolyn Keyes, Letart, W. Va.

[73] Assignee: Yokeyes-birthwear Inc., New Haven, W. Va.

[21] Appl. No.: 08/935,323

[22] Filed: Sep. 22, 1997

[51] Int. Cl.[6] ..... A41D 1/20

[52] U.S. Cl. ..... 2/83; 2/114; 2/78.2; 2/247

[58] Field of Search ..... 2/114, 78.2, 83, 2/80, 104, 111, 247, 70, 106, 113, 115, 121, 250, 253, 254, 69

[56] References Cited

U.S. PATENT DOCUMENTS

| | | | |
|---|---|---|---|
| 1,462,515 | 7/1923 | McElroy | 2/114 |
| 1,489,046 | 4/1924 | Thompson | 2/114 |
| 1,626,024 | 4/1927 | Crane | 2/104 |
| 2,520,026 | 8/1950 | Beitchman | 2/83 |
| 2,689,958 | 9/1954 | Gray | 2/83 |
| 2,814,044 | 11/1957 | Tucker | 2/80 |
| 4,004,294 | 1/1977 | Pinch | 2/104 |
| 4,422,186 | 12/1983 | Loney | 2/114 |
| 4,663,782 | 5/1987 | Knox et al. | 2/104 |
| 5,048,122 | 9/1991 | Prieur | 2/247 |
| 5,097,536 | 3/1992 | Cohen | 2/114 |
| 5,611,087 | 3/1997 | Adkins | 2/114 |
| 5,625,898 | 5/1997 | Telega | 2/78.2 |

FOREIGN PATENT DOCUMENTS

| | | | |
|---|---|---|---|
| 1757592 | 8/1992 | U.S.S.R. | 2/114 |
| 2246947 | 2/1992 | United Kingdom | 2/104 |

*Primary Examiner*—Amy B. Vanatta
*Attorney, Agent, or Firm*—Robert N. Blackmon

[57] ABSTRACT

Birthwear is provided comprising a top (shirt) and a bottom (pants) wherein the bottom has a front cloth layer and back cloth layer and an inner (crouch) seam (inseam) having a plurality of releasibly coupled elements (snaps) releasibly attaching the front layer to the back layer. The top also preferably has pockets on the front layer, each containing a hole for insertion of monitoring wires. The top preferably has an upper seam which runs along the shoulder and arms of the garment which has a plurality of coupling elements (snaps) for releasibly coupling the upper end of a front layer of the shirt with a upper end of a back layer of the shirt. The shirt preferably also has a back seam which runs from the neck of the shirt to the waist of the shirt along the center of the back providing the back with two back portions which are releasibly coupled with coupling elements (snaps) for permitting selective access to the back of the wearer. The present invention also involves a method for birthing comprising providing the above shorts, unsnapping (uncoupling) the coupling elements (snaps) and accessing the inner leg region of the wearer. The present birthing suit, specifically the bottoms, permit adequate access to the abdomen, perineum and chest while eliminating unnecessary exposure of the body in early and active laboring.

4 Claims, 3 Drawing Sheets

BIRTHWEAR AND METHOD RELATED THERETO

BACKGROUND OF THE INVENTION

1. Field of the Invention

The present invention relates to hospital clothing, and more particularly relates to hospital clothing for utilization during birthing.

2. Description of the Related Art

Hospital gowns typically involve a full length gown having an open back which may be drawn together by cloth draw strings attached to the back of the gown. Such gowns have historically suffered from being ineffective at conveniently covering the body of the user leading to a lack of privacy and inconvenience during use and do not generally permit adequate accessibility of areas such as the abdomen, perinem and chest areas.

Consequently, there is a need and desire for clothing suitable for pregnant women which will eliminate unnecessary exposure of the body during hospital stays and which will permit adequate accessibility of areas such as abdomen, perineum and chest areas.

SUMMARY OF THE INVENTION

Birthwear is provided comprising a top (shirt) and a bottom (pants, jams) wherein the bottom has a front cloth layer (front) and back cloth layer (back) and an inner (crouch) seam (inseam) having a plurality of releasibly coupled elements (snaps) releasibly attaching the front layer to the back layer. The top preferably has a pocket on the front layer containing a hole (in the front layer) for insertion of monitoring wires. The top preferably has an upper seam which runs along the shoulder and top of the arms of the garment which has a plurality of coupling elements (snaps) (along the upper seam) for releasibly coupling the upper end of a front layer of the shirt with a upper end of a back layer of the shirt. The shirt preferably also has a back seam which runs from the neck of the shirt to the waist of the shirt along the center of the back providing the back with two back portions which are releasibly coupled with coupling elements (snaps) for permitting selective access to the back of the wearer (person, pregnant woman). The present invention also involves a method for birthing comprising providing the above shorts, (unsnapping) uncoupling the coupling elements (snaps) and accessing the perineum (pelvis, urogenital passages, inner leg region) of the wearer. The present birthing suit permits adequate access to the abdomen, perineum and chest while eliminating unnecessary exposure of the body in early and active laboring.

DETAILED DESCRIPTION OF THE INVENTION

Figure 5:
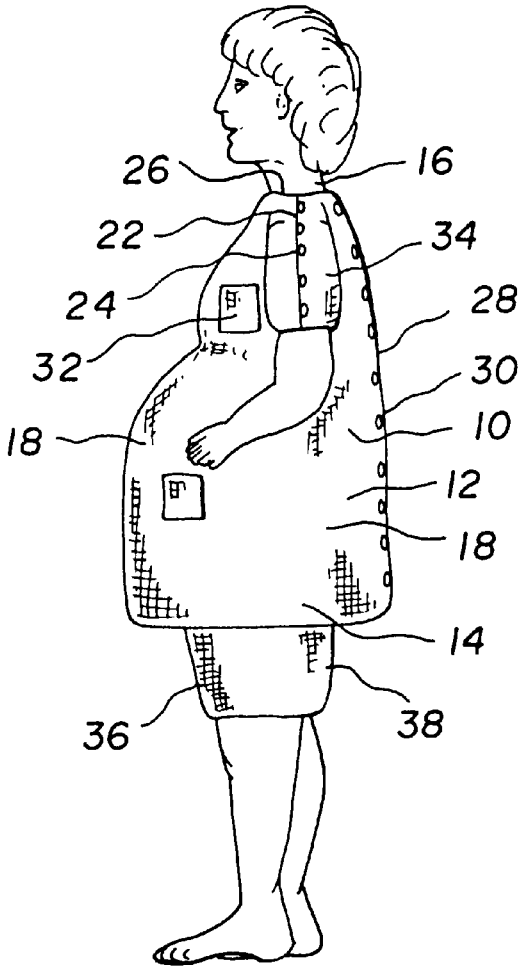
FIG. 5 is a side elevational view of a pregnant woman wearing a birthwear suit according to the present invention.

As best shown in FIG. 5, an expectant mother (pregnant woman) (16) wears the birthing outfit (suit) (10) which comprises a top (12) and a bottom (14).

Figure 1:
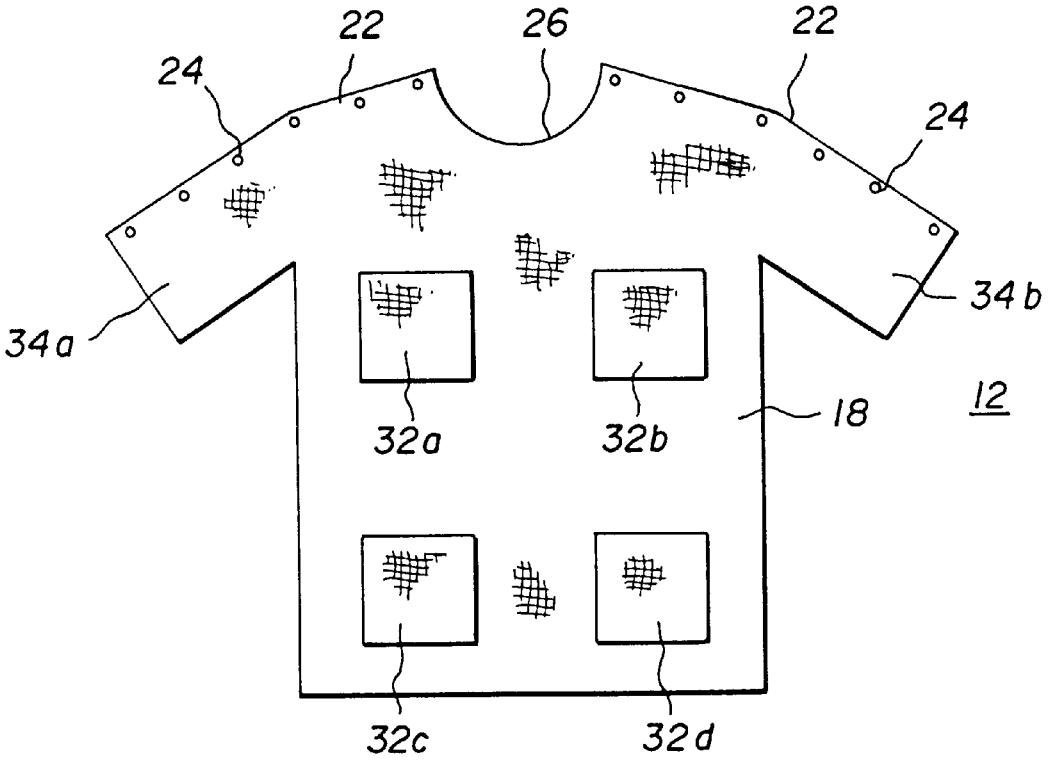
FIG. 1 is a front elevational view of a shirt according to the present invention.
Figure 3:
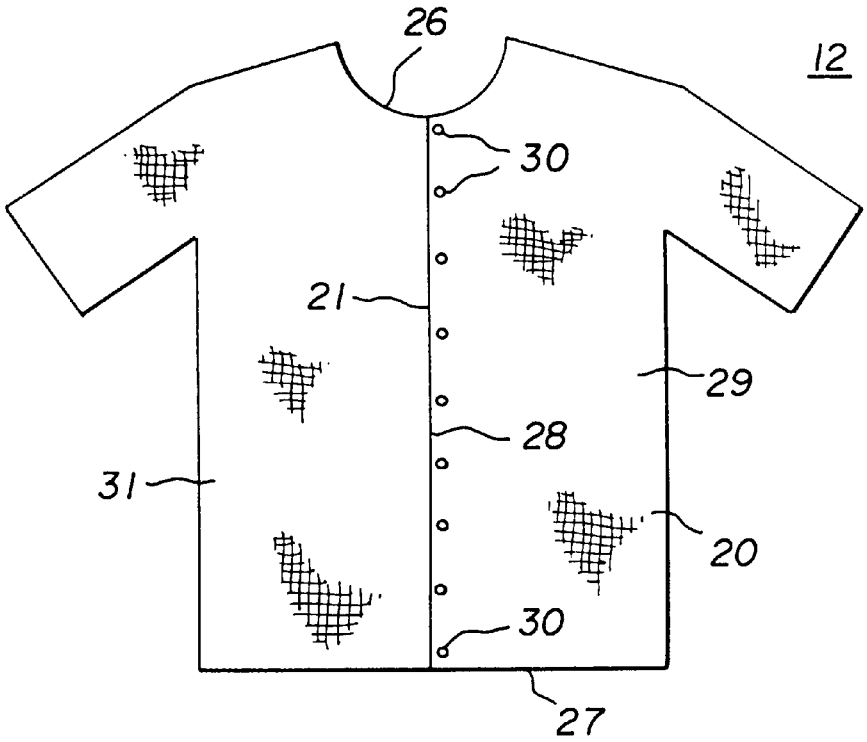
FIG. 3 is a rear elevational view of the shirt of FIG. 1.

As shown in FIGS. 1 and 3, the top (12) preferably comprises a front (18) and a back (20) which are in the form of cloth (fabric) layers. The top (shirt) (12) has an upper seam (22) which runs along the shoulder and upper (outer) arm regions of the shirt (12). The upper seam (22) has snaps (coupling elements) (24) which releasibly couple the front layer (18) and the back layer (20) at the respective upper regions of the layers (18,20). The shirt (12) has a neck opening (26) for the neck of the mother (16). The shirt (12) also preferably has a back seam (28) which runs from the neck opening (26) to the waist region (lower region) (27) of the shirt (12) along the center line of the back layer (20) adjacent the spine of the mother (16), and preferably has coupling elements (30) (snaps) for releasibly coupling the right (29) and lefthand (31) portions of the back layer (20) created by the back seam (21). The front (18) of the shirt (12) preferably has at least one shirt pocket (32*a,b,c,d*), and as shown in FIG. 1, the shirt also has sleeves (34*a, b*).

Figure 2:
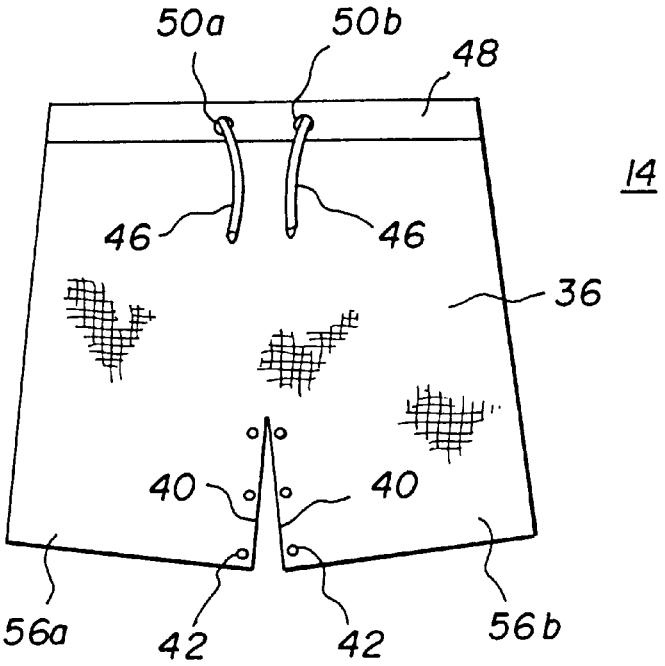
FIG. 2 is a front elevational view of a bottom according to the present invention.
Figure 4:
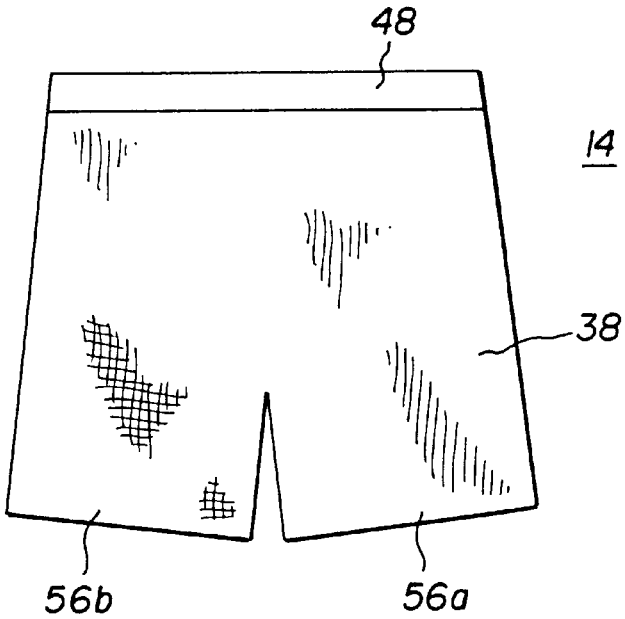
FIG. 4 is a rear elevational view of the bottom of FIG. 2.

The bottom (14) as best shown in FIGS. 2 and 4, preferably has a front layer (36) and a back layer (38). The bottom (14) has an inner crotch seam (40) wherein the front and back layers (36, 38) are releasibly coupled by a plurality of snaps (42) (coupling elements). The bottom (14) also preferably has a draw string (46) which is retained within an elastic tube (48) which has frontal ports (50*a, b*) for permitting end portions of the draw string (46) to extend therefrom. The bottoms (14) have pant legs (56*a, b*).

Figure 6:
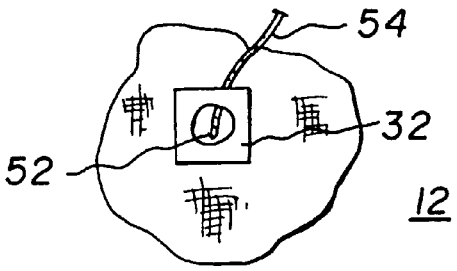
FIG. 6 is a cutaway of a pocket of a top having a front portion of a pocket cover panel cutaway to show an insertion hole.

As best shown in FIG. 6, the front birthwear top (12) also preferably has a two-inch button hole (52) for an EKG lead (wiring) (54) accessibility to be placed through the left pocket (32) for monitoring of the mother (16). The snaps placed on each arm (sleeve) (34) allows for easy accessibility of IV tubing maneuverability and to allow for exposure of a breast to breast feed an infant. The top (12) preferably also has an upper pair of pockets (32*a, b*) and a lower pair of pockets (32*c, d*) each having two inch button holes behind each of the pocket covers to allow for telementary of fetal heart rate (lead accessibility). The back of the top (12) also has snaps, discussed above, to allow for accessibility for back exposure to administer anesthesia such as epidurals, intrathecals and spinals. The bottoms (pants, jams) (14) have the holes (50*a, b*) for placement of the draw strings about the middle of the waist of the mother (person). Elastic in the waist allows for expansion of waist to place monitors on the abdomen for transducer (fetal heart) and to monitor to determine uterine contraction frequency and duration. Snaps placed in the inner legs (inseams) allow for accessibility of perineal area for sterile vaginal exams, artificial rupture of amniotic membranes, placement of intrauterine pressure catheter, foley insertion, exposure of perineal area for vaginal delivery or exposure of abdomen for cesarean delivery.

The present birthing wear will eliminate unnecessary exposure of the body in early and active laboring of patients, will promote individualism and freedom of choice of clothing to wear and labor and delivery, will provide adequate accessibility of areas such as abdomen, perineum and chest, and could be kept and saved by the user as a keepsake, heirloom and/or clothing usable for future hospital stays.

I claim:

1. A birthing suit comprising:

a top shirt having a front layer and a back layer and a shoulder portion;

a seam across said shoulder portion of said top shirt, said shirt seam having a plurality of coupling elements for releasably coupling said front layer to said back layer of said shirt and permitting said shirt to be opened along an upper most region thereof;

a bottom pant separate and unattached to said top shirt, said bottom having a front cloth layer and a back cloth layer;

said bottom further having a plurality of releasably coupled elements for attaching said front layer to said back layer;

a drawstring on said bottom pant for selectively tightening about a waist of a user to selectively secure said pant to the user;

at least three pockets on said top shirt front layer, each of said at least three pockets having an exterior pocket layer non-removably overlaying a portion of said front layer to define said pocket; and means defining a slit in said front layer of each of said at least three pockets for selectively passing monitoring equipment therethrough to an inner portion of said top shirt.

2. A birthing suit according to claim 1, having four of said pockets.

3. A birthing suit according to claim 2, wherein said slit is substantially two inches in length.

4. A birthing suit according to claim 1, wherein said slit is substantially two inches in length.

* * * * *